US006718961B1

(12) United States Patent
Woods et al.

(10) Patent No.: US 6,718,961 B1
(45) Date of Patent: Apr. 13, 2004

(54) FOOTBALL LAUNCHER

(76) Inventors: Ronald J. Woods, 201 Big Piece Rd., Fairfield, NJ (US) 07004; Nicholas Fayo, 17 Van Wagoner Ave., Clifton, NJ (US) 07013

( * ) Notice: Subject to any disclaimer, the term of this patent is extended or adjusted under 35 U.S.C. 154(b) by 0 days.

(21) Appl. No.: 10/383,045

(22) Filed: Mar. 6, 2003

(51) Int. Cl.[7] ..... F41B 3/04
(52) U.S. Cl. ..... 124/7; 473/438
(58) Field of Search ..... 273/129 R, 129 W; 473/438; 124/5, 6, 7, 8, 36, 31, 41.1

(56) References Cited

U.S. PATENT DOCUMENTS

| | | | | |
|---|---|---|---|---|
| 1,525,588 A | | 2/1925 | Moore | |
| 2,767,985 A | * | 10/1956 | Maxcey, Jr. et al. | |
| 3,552,371 A | | 1/1971 | Kahelin | 124/7 |
| 3,605,715 A | | 9/1971 | Welbourn | 124/7 |
| 3,662,728 A | | 5/1972 | Retrum | 124/1 |
| 3,722,494 A | | 3/1973 | Slevin | 124/7 |
| 3,788,297 A | | 1/1974 | Borst | 124/7 |
| 3,794,325 A | * | 2/1974 | Stender | 273/101 |
| 3,926,170 A | | 12/1975 | Dixon | 124/8 |
| 3,951,125 A | | 4/1976 | Dixon | 124/8 |
| 3,977,386 A | | 8/1976 | Meyer | 124/7 |
| 4,033,318 A | | 7/1977 | O'Grady | 124/7 |
| 4,082,076 A | | 4/1978 | Perry | 124/7 |
| 4,261,319 A | | 4/1981 | Dixon | 124/21 |
| 4,271,813 A | | 6/1981 | Rowe | 124/7 |
| 4,860,717 A | * | 8/1989 | Powell et al. | 124/7 |
| 5,207,421 A | | 5/1993 | Gorvin | 273/26 R |
| 6,050,906 A | * | 4/2000 | Stout et al. | 473/438 |
| 6,343,597 B1 | * | 2/2002 | Spikes | 124/7 |

* cited by examiner

*Primary Examiner*—Derris H. Banks
*Assistant Examiner*—Jamila Williams
(74) *Attorney, Agent, or Firm*—Sandra M. Kotin

(57) ABSTRACT

A football launcher and the method of using same, such that a player can practice receiving a hiked football without the need of another player being present. The football launcher has two triangular base members that support a mounting shaft between them. A pivot arm is rotatably mounted on the mounting shaft by means of an annular sleeve affixed to a point off center on the underside of the pivot arm. There is a fixed collar on each side of the sleeve to maintain the sleeve and therewith the pivot arm in a centered position on the mounting shaft. A football cradle is attached to the long end of the pivot arm and a step plate is attached to the short end. The football cradle is shaped to hold the football and release it in a straight line when the football launcher is activated. Activation is accomplished when the user steps on the step plate causing the football to be propelled in a low arc straight toward the user.

12 Claims, 6 Drawing Sheets

FOOTBALL LAUNCHER

FIELD OF THE INVENTION

The instant invention relates to a device for the launching of footballs during practice sessions and the method of using same.

BACKGROUND OF THE INVENTION

There have been a variety of devices developed for use in sports to aid athletes in honing their various skills. Many of these devices are used to launch balls to assist the athlete in hitting a ball in baseball practice or receiving a ball in football practice. There is great diversity in these devices, both in structure and in form.

Moore, in U.S. Pat. No. 1,525,588 teaches a game apparatus involving a base with a pivot bracket supporting an arm tensioned downward by a leaf spring. A semicircular support also attached to the base holds a round ball directly above the lower end of the arm. The user must strike the raised end of the arm with a bat. The lower end of the arm is then propelled upward hitting the ball and projecting it into the air whereby the user strikes the ball with the same bat. The leaf spring causes the arm to resume its lowered orientation. By requiring the user to strike both the arm and then the ball, the user's attention is divided making it difficult to hit the ball. Another ball launching device that also has a spring loaded pivot arm and requires the arm to be struck by a bat to propel the ball upward is taught by Gorvin, U.S. Pat. No. 5,207,421.

There are several spring activated ball throwing devices that are activated by one person while the released ball is thereafter propelled toward another person. Representative devices, all for launching baseballs, are disclosed by Kahelin in U.S. Pat. No. 3,552,371; Welbourn in U.S. Pat. No. 3,605,713; Slevin in U.S. Pat. No. 3,722,494; Borst in U.S. Pat. No. 3,788,297; and O'Grady in U.S. Pat. No. 4,033,318.

Similar spring activated devices for use in baseball practice have been developed. These can be activated by the same person that is hitting the ball without the need for another person to be present and are taught by Perry in U.S. Pat. No. 4,082,076; Rowe in U.S. Pat. No. 4,271,813; and Powell et al. in U.S. Pat. No. 4,860,717.

Launching a football presents different problems due to the shape of the ball itself. Retrum teaches a device to propel a toy football in U.S. Pat. No. 3,662,728. Two parallel upright panels are spaced apart on a base. A lever arm with a kicking leg and foot on one end and an impact block on the other end is pivoted between the panels. The panels have a forward sloping ramp that is shaped like a football. When the football is placed on the ramp and the block struck with the hand the football is propelled into the air and forward. The motion and trajectory of the football is determined by how the football is positioned on the ramp.

Several mechanical football passers that can launch a full sized football are known. Dixon, in U.S. Pat. No. 3,926,170, teaches a throwing arm mounted on a frame for pivotal movement. There is a ring-like ball holder at one end of the arm and springs attached at the other end. When activated) the arm is propelled in a horizontal plane and the springs provide a follow-through action. There is an adjustable stop that imparts a rotation to the ball and determines its direction. A timer enables the user to arm the device and then move into the field to receive the ball. Dixon has also developed another football passer disclosed in U.S. Pat. No. 3,951,125. A throwing arm is pivotally attached to a frame and has springs at one end. A second or cocking arm shares the same pivot post so that the springs are biased when the second arm is cocked. When the springs pivot the throwing arm the football is propelled from its open holder forwardly in an arc. There is also a time delay in the form of a rubber strip that is pulled through a slot until the throwing arm is freed. The user cocks the arm and moves into position to receive the ball. A safety shield protects the user when close to the device. A third football passer developed by Dixon and disclosed in U.S. Pat. No. 4,261,319 utilizes a U-shaped metal frame having two long side arms and a base. A small basket-like ball holder is biased by two crossed elastic cords. The ball holder also cooperates with a long guide rod and a timing device. The ball has an axial passage so that it may be set on the guide rod. When the ball holder is released the elastic cords propel it forward along the guide rod while rotating the ball so that it spirals as it is propelled into the air.

Meyer, in U.S. Pat. No. 3,977,386, discloses a football launching apparatus fully contained in a housing. There is a pivotally anchored door in the front of the housing through which the football is launched. A spring biased catapault arm with an angled basket to hold the football cooperates with a cocking mechanism to control when the football is launched. The basket has an open configuration to assure that no small objects can be launched. The configuration of the basket also provides spin as the ball is released. The user can cock the arm and move away from the apparatus to be in a position to receive the ball. The mechanism permits height adjustment and regulation of the trajectory of the ball. However, the mechanism is composed of many different parts and is contained totally within the housing which makes adjustments difficult. The apparatus appears clumsy which would hamper easy movement of the device from place to place.

All of the football passers involve spring activated catapault arms that fling the football outward and upward a considerable distance from the base or frame. They all utilize some sort of timing device so that the user can set the passer and run into the field to receive the football. All of the football passers are geared to assist the athlete in the practice of receiving a long pass. None of these devices would be helpful to a quarterback who wants to practice receiving the ball from the center, or the punter receiving the ball so he can kick it into the air. These practices require a short pass that is not propelled far forward and is not propelled high up into the air.

There is a need for an easily portable and lightweight football launcher that is controlled by the user, that propels the football outward in a manner similar the release of the football by the center while passing it to the quarterback at the onset of play. There is a need for such a device that can be used by athletes of all ages and sizes from the young player to the college player and the professional.

BRIEF SUMMARY OF THE INVENTION

The football launcher of the present invention may be used in practice by a quarterback or punter who must receive the football by means of a short pass from another player and then either run with the football, pass it to a teammate, or kick the football. The football launcher may have a unique football cradle to assure that the football is propelled in a straight line. The football launcher may have an off center pivot arm with the ball cradle attached at one end and a step plate at the other end. The pivot arm may be supported by a mounting shaft suspended between two triangular stanchions. Alternate stanchions may permit a change of height for the mounting shaft and may enable the launcher to be used by athletes of different sizes ranging from young children to professional players. Anchor pins may be used to fix the stanchions into the ground for stability.

It is an object of the present invention to provide a football launcher that is lightweight and portable.

A further object of the present invention is to provide a football launcher that can easily be assembled for use and disassembled for storage and transport.

It is another object of the present invention to provide a football launcher that has more than one set of supports or stanchions to accommodate players of all sizes.

A further object of the present invention is to provide a football launcher that is easily controlled by the user.

Another object of the present invention is to provide a football launcher that does not require the assistance of another person.

A still further object of the present invention is to have the football propelled in a straight path by virtue of the unique design of the football cradle.

Another object of the present invention is to provide a football launcher that is easy and economical to manufacture.

The football launcher for use in practice sessions by a single player comprises two base members for supporting the football launcher on a horizontal surface; a mounting shaft suspended between the two base members; and a pivot arm being longer than the mounting shaft. There is an annular sleeve affixed off center to the underside of the pivot arm and the position of the sleeve denotes a shorter section and a longer section of the pivot arm. The mounting shaft passes through the sleeve and rotatably supports the pivot arm. A step plate is affixed to the pivot arm at the end of the shorter section and a football cradle is affixed to the pivot arm at the end of the longer section. When a football is placed within the cradle and a user is positioned near the step plate and steps on the step plate the football is propelled in the direction of the user simulating the action of a passed football and the user catches the football.

A method by which a receiver can practice the skill of catching a football that is hiked from a player to the receiver without the need of the other player being present. The method comprises the steps of first obtaining a football launcher which comprises two triangular base members each having angled apertures in the lower ends of each leg and anchoring pins for supporting the football launcher on a penetrable horizontal surface, a mounting shaft suspended between said two base members, a pivot arm being longer than the mounting shaft, an annular sleeve affixed off center to the underside of the pivot arm, the position of said sleeve denoting a shorter section and a longer section of said pivot arm, and said mounting shaft passing through the sleeve and rotatably supporting the pivot arm, a step plate affixed to the pivot arm at the end of the shorter section, and a football cradle affixed to the pivot arm at the end of the longer section. The other steps include placing the football launcher on the penetrable horizontal surface; inserting the anchoring pins through the angled apertures so that they extend beyond the apertures and into the penetrable horizontal surface such that the football launcher is anchored in place; placing a football into the football cradle such that the cradle end of the pivot arm thereafter is lowered and contacts the penetrable horizontal surface; moving to the step plate end of the football launcher; and stepping on the step plate. The football is propelled from the football cradle in a low arc while making an axial rotation of 180° straight toward the receiver, and the receiver catches the football and thereafter elects to pass the football, run with the football or punt the football.

Other features and advantages of the invention will be seen from the following description and drawings.

DETAILED DESCRIPTION OF THE INVENTION

Figure 1:
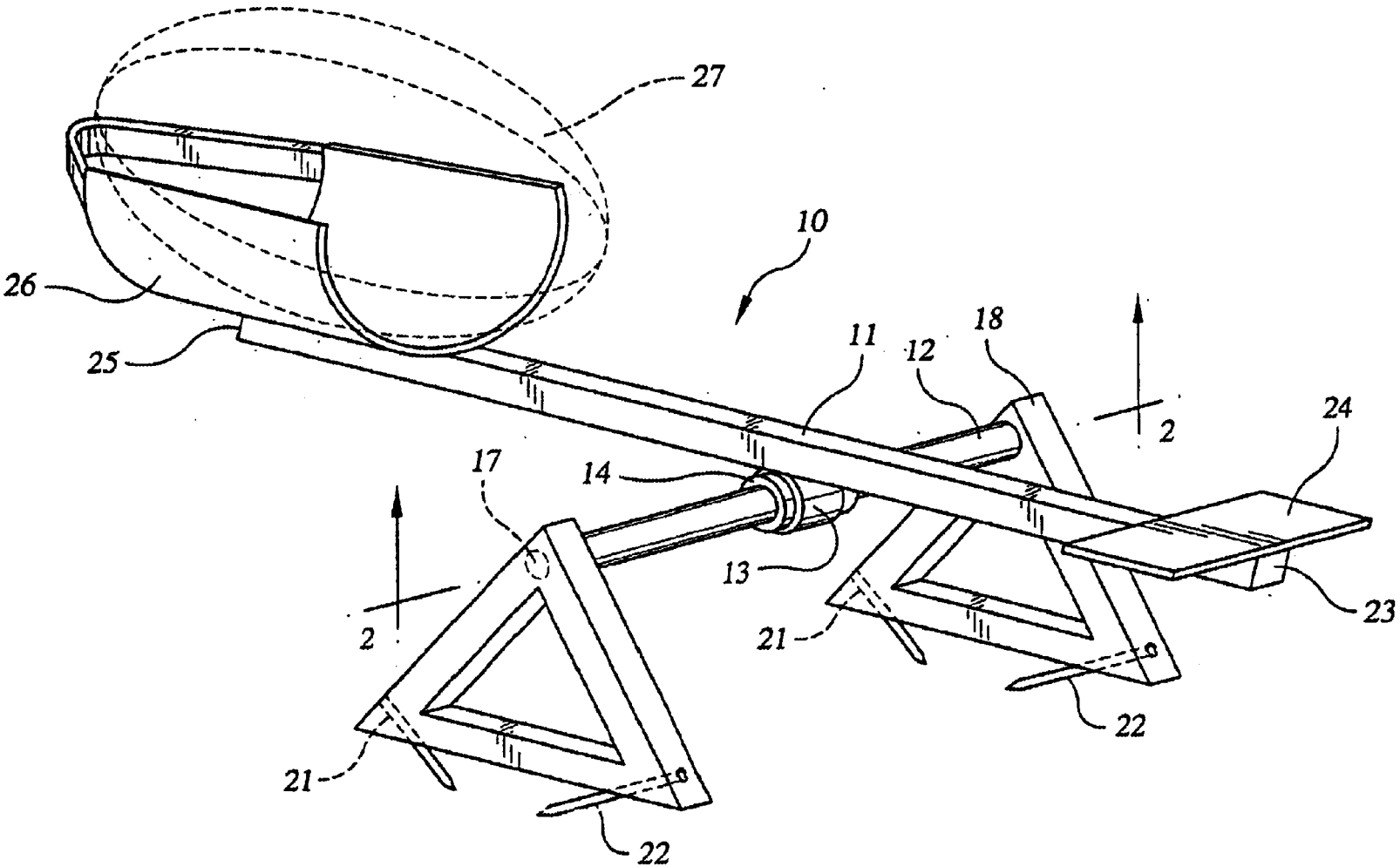
FIG. 1 is a perspective view of the football launcher of the present invention.
Figure 2:
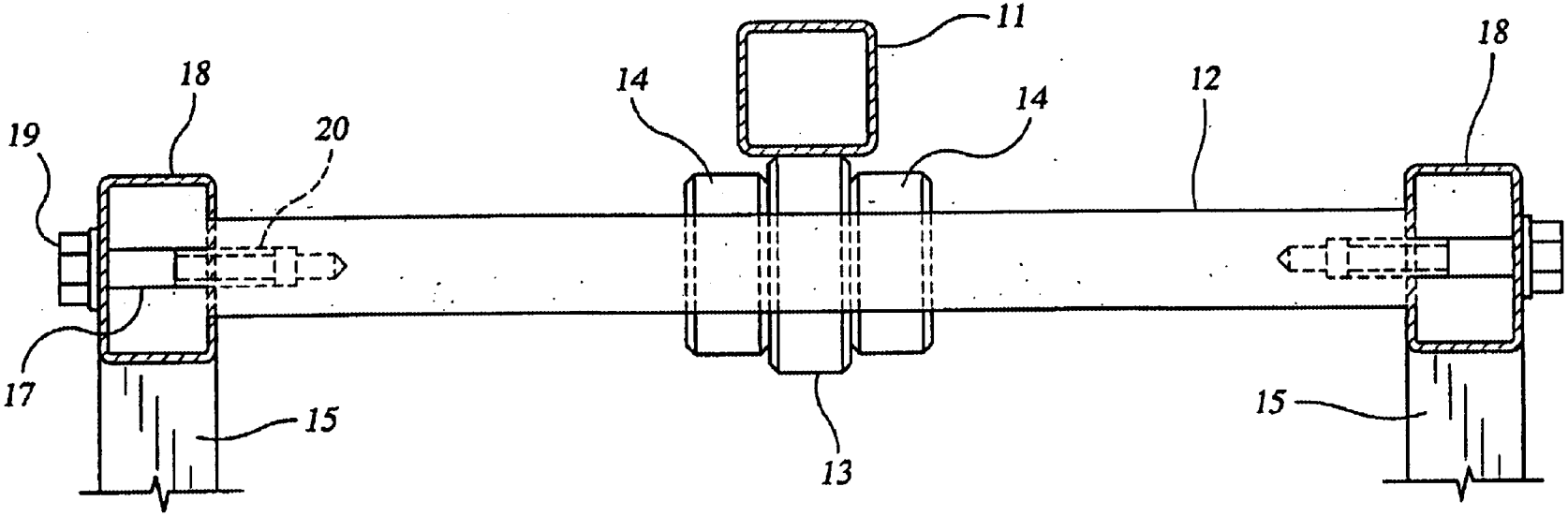
FIG. 2 is a partial section through line 2—2 of FIG. 1.

The football launcher 10 of the present invention may be seen in FIG. 1. The football launcher may be supported by two stanchions 15 which may be triangular in shape, though other shapes may be used. There may be an aperture 17 in the apex 18 of each triangular stanchion 15. A mounting shaft 12 having a threaded opening 20 in each end may be suspended between the two stanchions 15. The mounting shaft 12 may be held in place by means of cap screws 19 which may pass through the apertures 17 in the stanchions 15 and cooperate with the threaded openings 20. These structures may be seen in FIG. 2.

A pivot arm 11 may be rotatably attached to the mounting shaft 12 by means of an annular mounting member or sleeve 13 affixed off-center to the underside of the pivot arm 11. The pivot arm 11 may be centered on the mounting shaft 12 and maintained in place by means of two collars 14, each fixedly attached to the mounting shaft 12 on either side of the sleeve 13.

The bases 16 of the stanchions 15 may rest directly on the ground 28. There may be diagonal openings 21 through each leg of the bases 16 for the insertion of stabilizing or anchoring pins 22 that may extend into the ground 28 to anchor the football launcher 10 and maintain it securely in place during use. See FIGS. 6 and 7.

Figure 8:
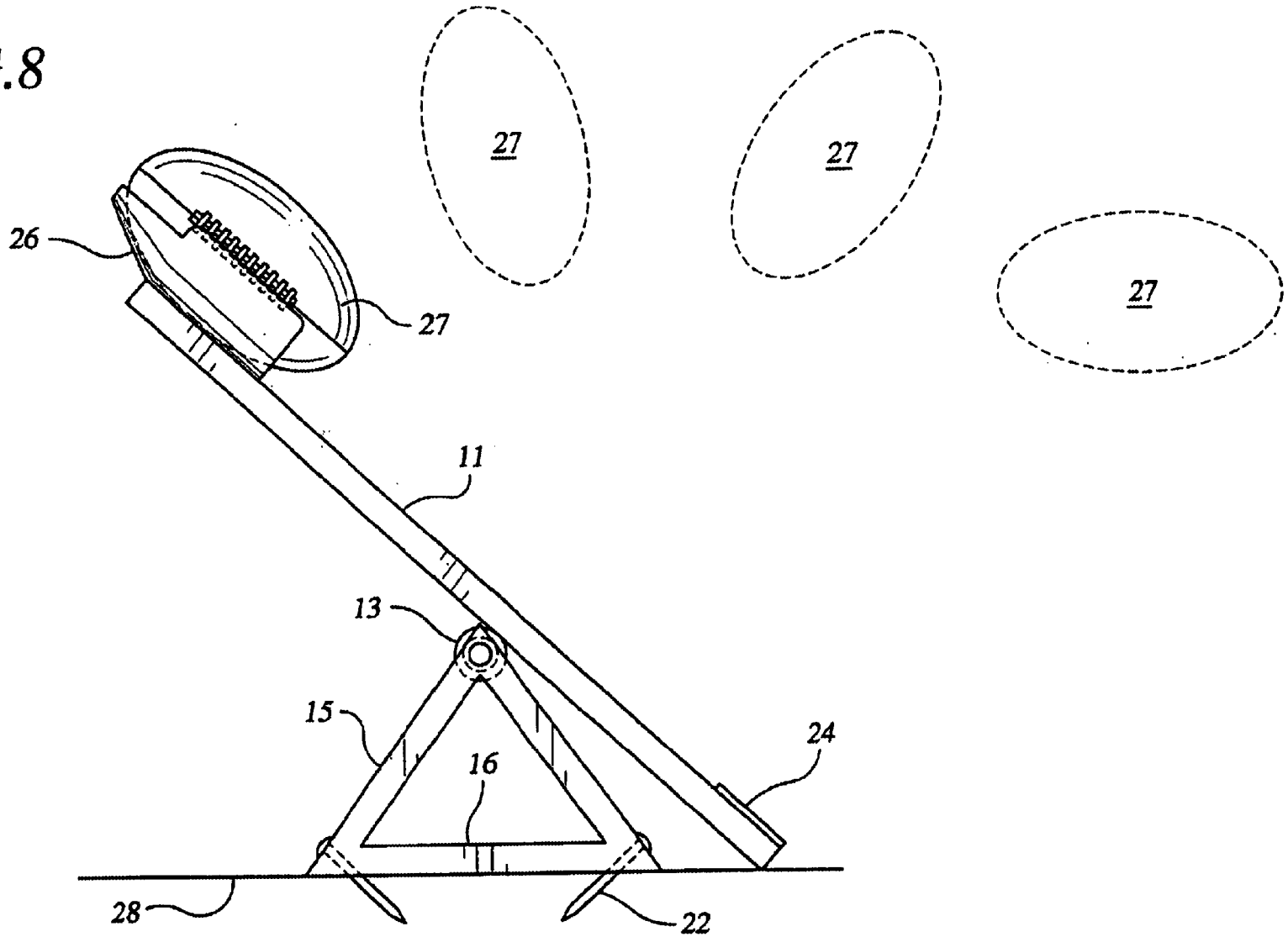
FIG. 8 is a side view of the football launcher of the present invention in the launch position and showing the trajectory of the football.

There may be a flat rectangular step plate 24 attached to the short end 23 of the pivot arm 11. The step plate 24 may be sized such that it may be quickly and easily stepped on by the user. Affixed to the longer end 25 of the pivot arm may be a football holder or cradle 26. The football 27 may be held in the cradle 26 in such a manner that when the step plate 24 is stepped on, the force expended may be transferred through the pivot arm 11 and may cause the cradle to move upward releasing the football 27 in a trajectory directed toward the user. (FIG. 8) The unique design and construction of the cradle 26 may determine this trajectory which may simulate the hiking of the football from the center to the quarterback as may be usual at the beginning of a play.

Figure 5:
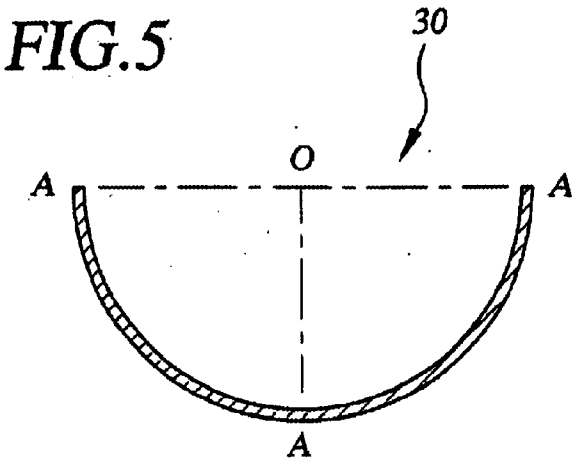
FIG. 5 is a section along 5—5 of FIG. 3.
Figure 3:
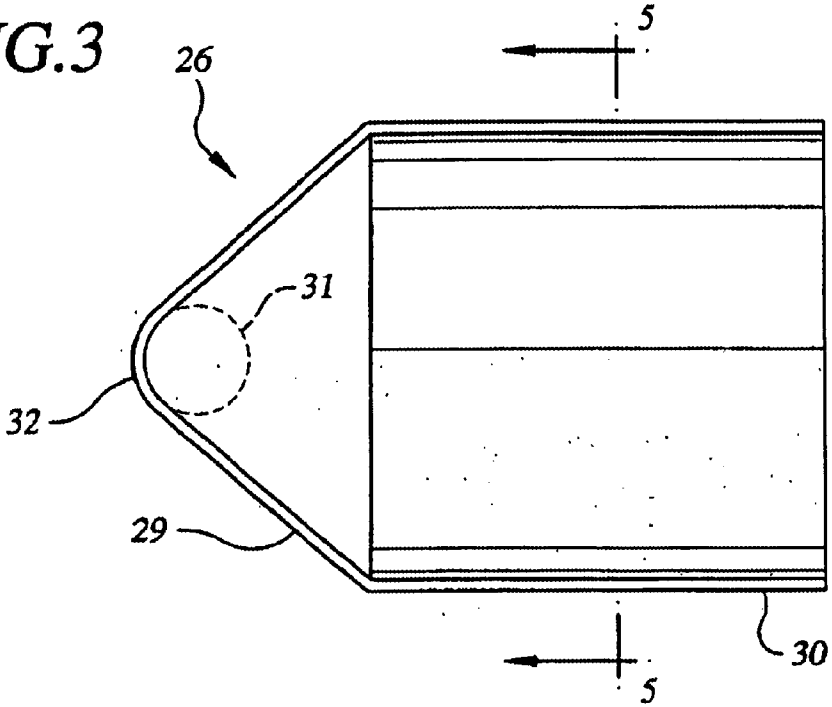
FIG. 3 is a top plan view of the football cradle.
Figure 4:
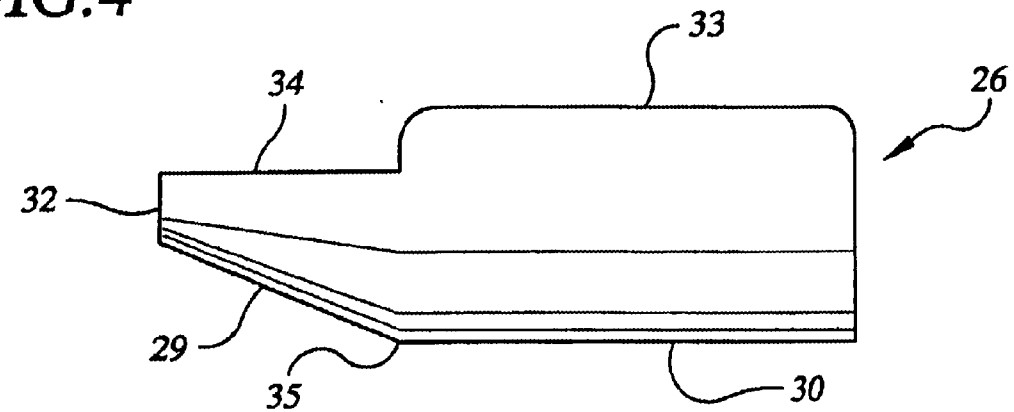
FIG. 4 is a side plan view of the football cradle.

The specific contours of the cradle 26 may hold the football 27 securely and in the necessary orientation so that it may be released smoothly and quickly toward the user when the step plate 24 is stepped on. The cradle 26 may be composed of two contiguous sections, the forward section 29, and the rearward section 30. The sides of the forward section 29 may taper toward an apex 32 such that the forward section 29 may be somewhat conical in shape with the apex 32 being curved as an arc of a circle 31 which may be seen in phantom lines in FIG. 3. This circle may have a radius of 1 inch to accommodate the end of the football 27. The rearward section 30 may be semicircular in cross section. See FIG. 5. The lines O-A in FIG. 5 may represent radii of a circle with a radius of 3.5 inches. These measurements may depend upon the dimensions of the conventional football. The longitudinal edges 33 of the rearward section 30 may extend above the edges 34 of the forward section 29. See FIG. 4. The extension of the rearward longitudinal edges 33 may provide better hold for the football 27 and prevent the football from wobbling when released. The lower edges 34 of the forward section 29 may enable a cleaner release when the football 27 is propelled out of the cradle 26.

Figure 6:
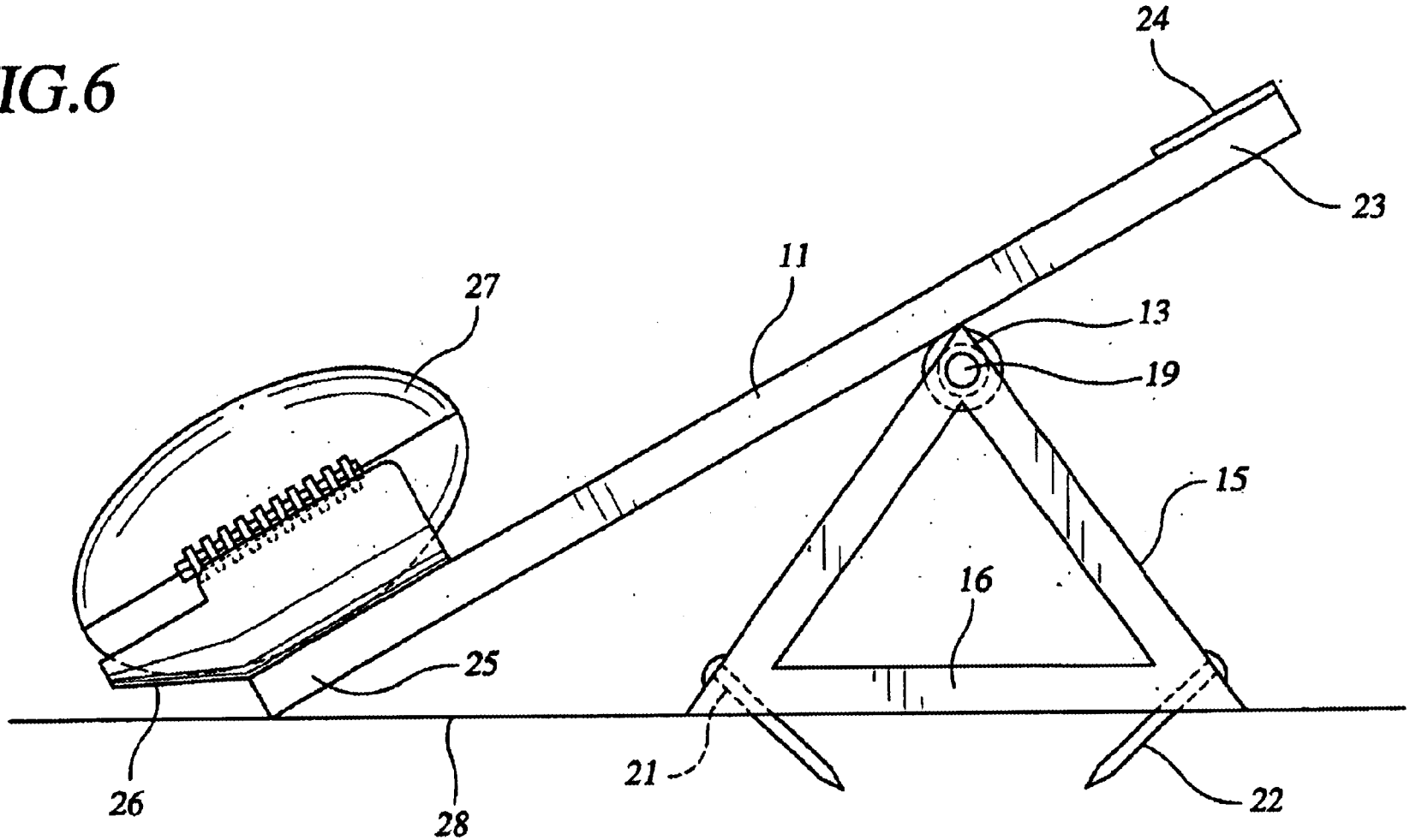
FIG. 6 is a side view of the football launcher of the present invention ready for launching.

The height of the stanchions 15 may determine the height of the arc of the trajectory of the football 27 when it is released from the cradle 26. Since the football launcher 10 can be used by persons of different sizes, from young children to professional players, different heights may be necessary. For this reason, more than one set of stanchions may be provided, each of different dimensions. FIG. 6 may show stanchions 15 of one size and FIG. 7 may show smaller stanchions 36 for use by the shorter or smaller player. The use of the cap screws 19 and threaded openings 20 in the mounting shaft 12 may make the changing of the stanchions an easy task. This construction may also enable the stanchions of the football launcher 10 to be easily removed for transport or storage.

The football launcher 10 of the instant invention may be made of metal, but other materials may be used as long as the material is strong and resilient. Typically, the mounting shaft 12 may be a 1 inch (2.54 cm) diameter rod that is drilled 0.75 in (1.90 cm) deep with a ⅜ in (0.95 cm) tap at each end. The collars 14 may be 1 in (2.54 cm) wide and ⅝ in (1.58 cm) thick. The collars 14 may be held in place by spot welding or by having a hole drilled and tapped with a ¼ in (0.63 cm) set screw.

The pivot arm 11 may be constructed of 1 in square metal tubing that may be 32.5 in (82.6 cm) in length and may be capped at each end with ¼ in (0.63 cm) caps. The annular mounting member 12 may be 1 in (2.54 cm) wide with a 1 9/16 in (3.97 cm) outer diameter. The annular mounting member 12 may be welded to the pivot arm 11 at a point 14 in (35.6 cm) from the short end 23. The step plate 24 may be 4 in (10.1 cm) by 6⅝ in (16.8 cm) and ¼ in (0.63 cm) thick, and may be welded to the short end 23 of the pivot arm 11 such that the wide edge of the step plate 24 may be centered on and even with the short end 23 of the pivot arm 11.

The overall length of the cradle 26 may be 9¾ in (24.8 cm) with the rearward section being 6½ in (16.5 cm) in length. The cradle 26 may be spot welded to the pivot arm 11 so that the juncture 35 of the forward section 29 and rearward section 30 may be situated at the long end 25 of the pivot arm 11.

One set of stanchions 15 may have legs that are 11⅝ in (29.5 cm) in length and a base that is 14½ in (36.8 cm) in length. The height of this stanchion 15 at the apex may be 9 in (22.9 cm). The apex angle may be 76° and the base angles may be 52°. A second smaller set of stanchions 36 may have legs that are 8¾ in (22.2 cm) long and a base that may be 9⅝ in (24.4 cm) long so that the height of the triangular stanchions may be 7⅜ in (18.7 cm). The apex angle may be 70° and the base angles may be 55°. Other stanchions may be smaller or larger to accommodate a variety of users. The lower the height of the stanchions, the lower may be the path of the football.

Figure 7:
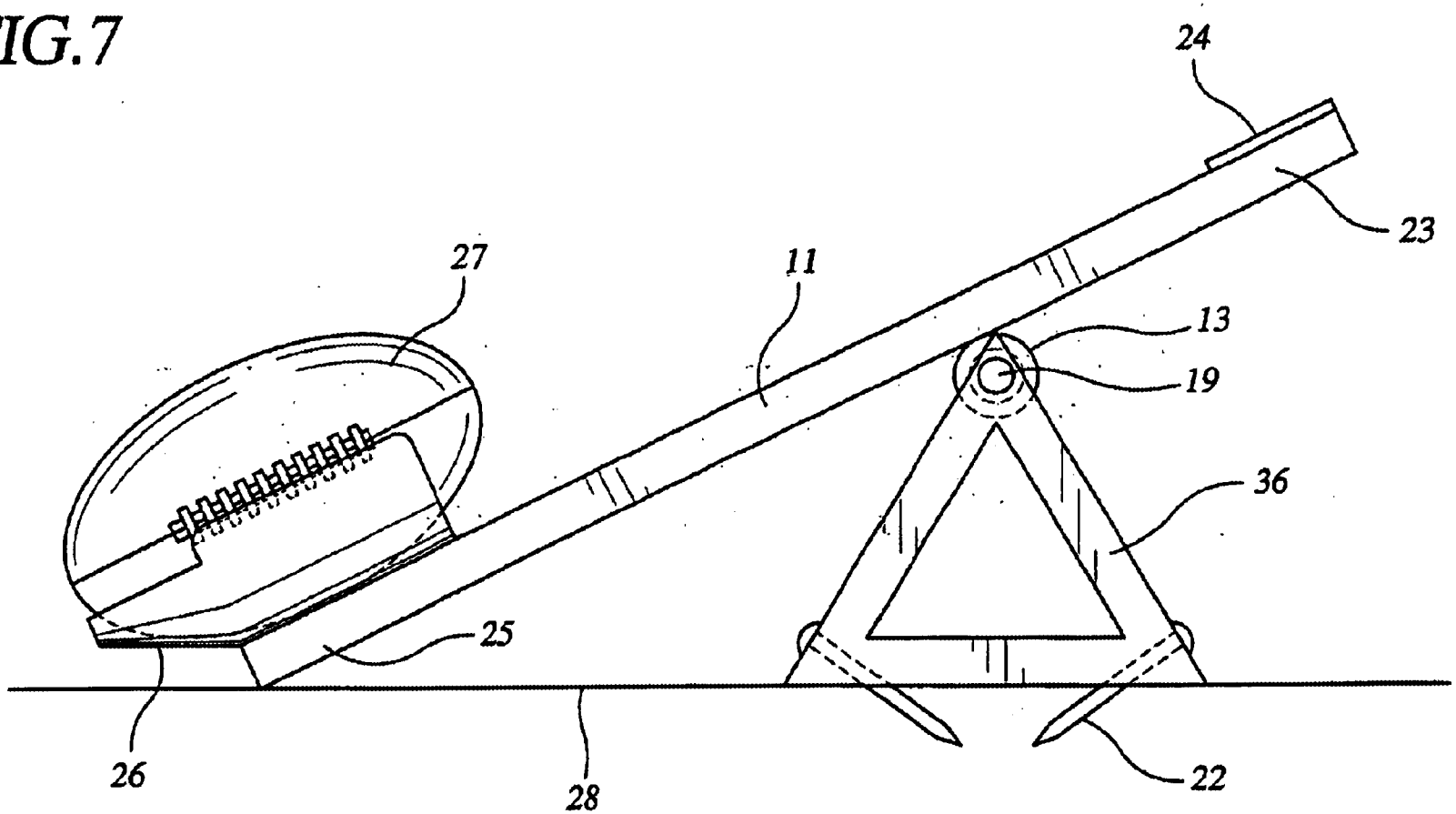
FIG. 7 is a side view of the football launcher of the present invention with an alternate set of stanchions.

In use, the football launcher 10 may be placed on the ground 28, ideally in a flat open area. The anchoring pins 22 may be inserted through the diagonal openings 21 and into the ground 28 so the football launcher 10 cannot move when in use. The user may place the football 27 into the cradle 26 which may cause the cradle end or long end 25 of the pivot arm 11 to become lowered as seen in FIGS. 6 and 7. The user may then move to the short end 23 of the pivot arm 11 and when ready, step heavily on the step plate 24 which may cause the long end 25 to rise sharply and propel the football 27 toward the user. The trajectory of the football 27 may be seen in FIG. 8. The football may make a half revolution, or 180° axial rotation, and then move straight toward the user who may then catch football. The user may thereafter run with the ball, pass the ball or kick the ball. The action of the football launcher 10 may be the simulation of the action of the center hiking the football to the quarterback. The football launcher 10 may make it possible for the quarterback to practice without the need of having the center hike the ball to him. It may also be used to assist the punter in practice. The off-center positioning of the pivot arm 11 and the dimensions of the football launcher 10 may assist in allowing the football to travel only as high and as far as needed to accomplish the aforesaid goals.

While one embodiment of the present invention has been illustrated and described in detail, it is to be understood that this invention is not limited thereto and may be otherwise practiced within the scope of the following claims.

We claim:

1. A football launcher for use in practice sessions by a single player, said football launcher comprising:

two base members for supporting the football launcher on a horizontal surface;

a mounting shaft suspended between said two base members;

a pivot arm being longer than the mounting shaft;

an annular sleeve affixed off center to the underside of the pivot arm, the position of said sleeve denoting a shorter section and a longer section of said pivot arm, and said mounting shaft passing through the sleeve and rotatably supporting the pivot arm;

a step plate affixed to the pivot arm at the end of the shorter section; and a football cradle affixed to the pivot arm at the end of the longer section;

whereby when a football is placed within said cradle and a user is positioned near the foot plate and steps on the step plate the football is propelled in the direction of the user simulating the action of a hiked football and the user catches the football.

2. A football launcher as in claim 1 wherein the base members are triangular.

3. A football launcher as in claim 2 further comprising angled apertures in the lower ends of each leg of the triangular base members and anchoring pins, such that said anchoring pins may be placed within said apertures and extend into a penetrable horizontal surface to anchor and stabilize the football launcher thereon.

4. A football launcher as in claim 2 further comprising an opening in the apex of each triangular base member.

5. A football launcher as in claim 4 further comprising a bore in each end of the mounting shaft and pins that pass through the openings in the base members and cooperate with said bores whereby the mounting shaft is maintained in place between the base members.

6. A football launcher as in claim 5 wherein the bores are threaded and the pins are threaded to coact with the bores whereby the mounting shaft is securely maintained in connection with and between the base members.

7. A football launcher as in claim 1 wherein the mounting shaft is reversibly suspended between the two base members.

8. A football launcher as in claim 7 further comprising at least one additional pair of base members, said additional base members being of different dimensions so that the additional pair of base members supports the mounting shaft at a different height to accommodate players of a different size.

9. A football launcher as in claim 1 further comprising two fixed collars surrounding the central portion of the mounting shaft, said collars being spaced apart such that the sleeve fits rotatably between them.

10. A football launcher as in claim 1 wherein the football cradle comprises two contiguous sections, a forward section in the shape of a half cone with the apex of the half cone being configured as an arc of a circle, and a rearward section in the form of an elongated portion being semicircular in cross section.

11. A football launcher as in claim 10 wherein the longitudinal edges of the rearward section are higher than the edges of the forward section to better guide the football as it is propelled from the cradle during use.

12. A method by which a receiver can practice the skill of catching a football that is hiked from a player to the receiver without the need of the other player being present, said method comprising the steps of:

obtaining a football launcher which comprises two triangular base members each having angled apertures in the lower ends of each leg and anchoring pins for supporting the football launcher on a penetrable horizontal surface, a mounting shaft suspended between said two base members, a pivot arm being longer than the mounting shaft, an annular sleeve affixed off center to the underside of the pivot arm, the position of said sleeve denoting a shorter section and a longer section of said pivot arm, and said mounting shaft passing through the sleeve and rotatably supporting the pivot arm, a step plate affixed to the pivot arm at the end of the shorter section, and a football cradle affixed to the pivot arm at the end of the longer section;

placing the football launcher on the penetrable horizontal surface;

inserting the anchoring pins through the angled apertures so that they extend beyond the apertures and into the penetrable horizontal surface such that the football launcher is anchored in place;

placing a football into the football cradle such that the cradle end of the pivot arm thereafter is lowered and contacts the penetrable horizontal surface;

moving to the step plate end of the football launcher; and stepping on the step plate;

whereby the football is propelled from the football cradle in a low arc while making an axial rotation of 180° straight toward the receiver, and the receiver catches the football and thereafter elects to pass the football, run with the football or punt the football.

* * * * *